United States Patent [19]

Heatwole

[11] 4,285,516

[45] Aug. 25, 1981

[54] AMUSEMENT AND/OR EXERCISING DEVICE

[75] Inventor: Richard Heatwole, Decatur, Ill.

[73] Assignee: James A. Southerland, Marshall, Ill.; a part interest

[21] Appl. No.: 119,327

[22] Filed: Feb. 7, 1980

[51] Int. Cl.[3] ..... A63B 23/04

[52] U.S. Cl. ..... 272/146; 272/70

[58] Field of Search ..... 273/80.1; 272/33 R, 272/33 A, 70, 70.3, 93, 96, 97, 111, 146, 144; 280/1.11 R, 1.175, 1.177, 1.181, 205, 206; 128/25 R, 25 B

[56] References Cited

U.S. PATENT DOCUMENTS

| | | | |
|---|---|---|---|
| 2,206,902 | 7/1940 | Kost | 128/25 B |
| 2,714,007 | 7/1955 | Jordan | 272/146 |
| 2,930,613 | 3/1960 | Katz | 272/146 |
| 2,941,801 | 6/1960 | Pedersen | 272/70 |
| 3,010,719 | 11/1961 | Johnson | 272/144 X |
| 3,108,802 | 10/1963 | Sundquist | 272/70 X |
| 3,310,320 | 3/1967 | Hanna | 272/146 X |
| 3,416,792 | 12/1968 | Morgan et al. | 272/146 |
| 3,438,626 | 4/1969 | Modla | 272/70 |
| 3,560,035 | 2/1971 | Kindel | 273/80.1 X |
| 3,713,653 | 1/1973 | Romans | 272/146 X |
| 3,879,033 | 4/1975 | Martin | 272/111 |
| 3,967,820 | 7/1976 | Harper | 272/1 R |
| 4,159,111 | 6/1979 | Lowth | 272/96 |
| 4,186,920 | 2/1980 | Fiore et al. | 272/96 |

FOREIGN PATENT DOCUMENTS

| | | | |
|---|---|---|---|
| 2439402 | 3/1976 | Fed. Rep. of Germany | 272/70 |
| 196028 | 4/1923 | United Kingdom | 272/70 |

*Primary Examiner*—Richard J. Apley

*Attorney, Agent, or Firm*—Seidel, Gonda, Goldhammer & Panitch

[57] ABSTRACT

The device includes first and second pads each of which is adapted to support one leg of a person. The pads are rigidly interconnected together. Each pad has a ground engaging element below and associated therewith. A generally spherical bearing is provided between each ground engaging element and its associated pad so that each pad may tilt and/or rotate relative to its ground engaging element.

7 Claims, 3 Drawing Figures

AMUSEMENT AND/OR EXERCISING DEVICE

RELATED CASE

References made to co-pending design patent application Ser. No. 73,831 filed Sept. 10, 1979 and entitled BALANCING TOY.

BACKGROUND

Devices of the general type involved herein are known. See U.S. Pat. Nos. 2,930,613 and 3,438,626 wherein the ground engaging elements are integral with the associated pads. It is known from U.S. Pat. No. 3,108,802 to provide for pivotable movement between a pad and its ground engaging element. It is also known from U.S. Pat. No. 3,310,320 to provide a skate board with spherical ground engaging elements.

SUMMARY OF THE INVENTION

The present invention is directed to a device which may be used as a walking toy or as an exerciser. The device includes first and second pads each of which is adapted to support one leg of a person. A means is provided for rigidly interconnecting the pads. Each pad is provided with a ground engaging element.

In such a device, the improvement is directed to a means which permits the pads to be tilted with respect to each other while permitting a pad to rotate with respect to its ground engaging element. In accomplishing this goal, each pad has a concave bearing socket which approximates a $\frac{3}{4}$ sphere on the bottom surface thereof. A generally spherical bearing is provided in each socket. Each bearing is rigidly connected to one of the ground engaging elements. Each element together with its bearing is pivotable relative to its associated pad for movement of the pads through a limited arc to thereby facilitate tilting of the pads relative to ground level. Each bearing permits its associated pad to rotate relative to its associated ground engaging element.

It is an object of the present invention to provide a novel amusement and exercising device which is structurally interrelated in a manner which is simple, reliable, and easy to manufacture whereby a bearing facilitates tilting and/or rotation of a pad relative to its ground engaging element.

Other objects and advantages of the present invention will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
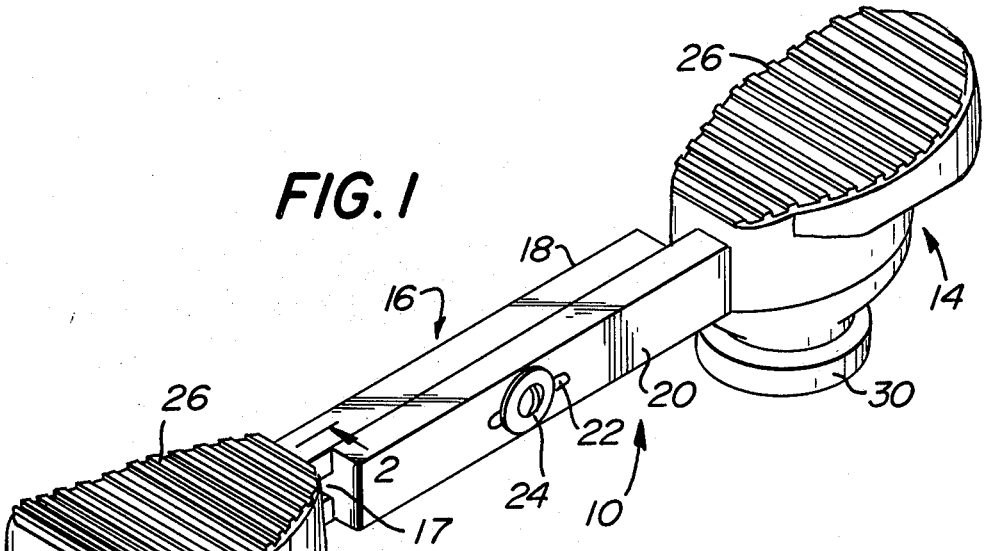
FIG. 1 is a perspective view of the device in accordance with the present invention.

Referring to the drawing in detail, wherein like numerals indicated like elements, there is illustrated a device in accordance with the present invention and designated generally as 10.

The device 10 includes a pair of pads designated 12 and 14. The pads are rigidly connected together by a connecting means 16. The connecting means may be integral in one piece with the pads. In a preferred embodiment of the invention, connecting means 16 includes a pair of arms 18 and 20.

Arm 18 is molded in one integral piece from a plastic material with the pad 12. Arm 18 has a groove 19 on a sideface thereof. See FIG. 2. The pad 14 is molded in one integral piece from plastic material with the arm 20. Arm 20 has a tongue 17 adapted to be received within the groove 19. Arm 20 has a slot 22 extending therethrough. A fastener 24 of the nut and bolt type extends through the slot 22 and interconnects the arms 18–20 in a manner whereby they may be longitudinally adjusted relative to one another to increase of decrease the distance between the pads 12 and 14. Such adjustability enables the device 10 to be used by children as well as grownups.

The outermost ends of the pads 12 and 14 are thicker or are otherwise constructed so as to be at a higher elevation from the ground as compared with the elevation of the innermost end of the pads. See FIG. 2. The uppermost surface of the pads 12 and 14 are provided with an anti-slip coating 26 made from a plastic material adhesively bonded to the pads or attained by molding the pads 12 and 14 with such a surface integral in one piece therewith. These features inhibit slipping between the pad and the bottom of a persons foot when the pads are tilted with respect to ground level. Pad 12 has a ground engaging element 28. Pad 14 has a ground engaging element 30.

Each pad is connected to its associated ground engaging element by a means which facilitates tilting and/or rotation of the pad with respect to its ground engaging element. Since the respective means are identical, only the interrelationship of pad 12 and its ground engaging element will be described in detail.

Figure 2:
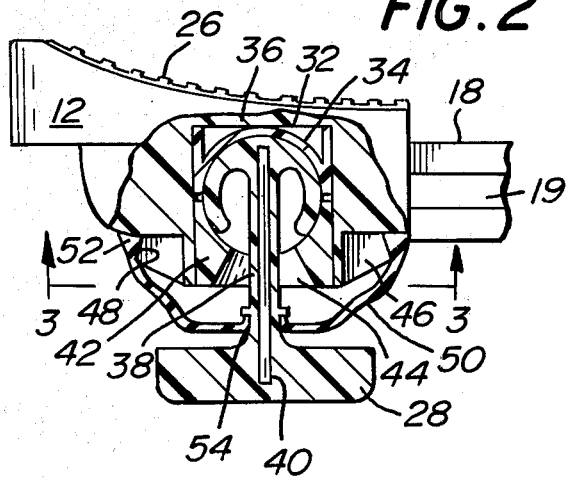
FIG. 2 is a sectional view taken along the line 2—2 in FIG. 1.
Figure 3:
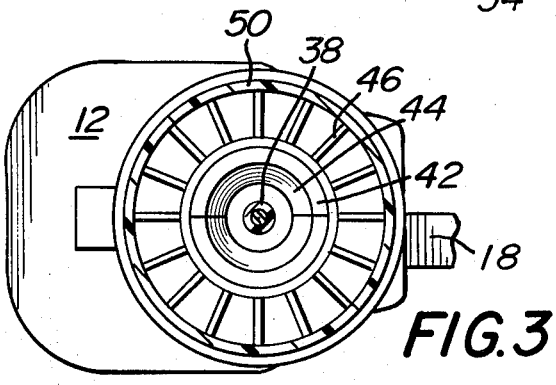
FIG. 3 is a sectional view taken along the line 3—3 in FIG. 2.

Referring to FIG. 2, the bottom surface of the pad 12 is provided with a cavity 32 which is circular in section as will be apparent from FIG. 3. Within the cavity 32, there is fixedly secured a bearing insert 34. Such securement may be attained by use of adhesive or the like. Insert 34 has a semicircular spherical surface. A generally spherical bearing 36 is in contact with the semispherical surface on insert 34.

Bearing 36 is integral in one piece with the ground engaging element 28 by way of a stem or shaft 38. Thus, I prefer to mold the ground engaging element 28 and its bearing 36 from a polymeric plastic material. Within the bearing 36, stem 38, and element 28 there is provided a reinforcing insert in the form of a pin 40.

The bearing 36 is retained within the cavity 32 by a retainer insert 42. Insert 42 is preferably in mating halves which are adhesively bonded in place as shown in FIG. 2. The insert 42 has a generally semispherical surface juxtaposed to the bearing 36 on the upper surface of insert 42. The upper surface of the insert 42 is interrupted by a conical hole 44 through which the stem 38 extends. The surfaces on the inserts 34 and 42 constitute approximately a $\frac{3}{4}$ sphere. As a result of using a conical hole 34, the pad 12 may rotate about the axis of stem 38 and may also tilt through a limited arc of about 60° as defined by the taper of hole 44.

Surrounding the cavity 32, the bottom surface of the pad 12 is provided with a plurality of radially disposed reinforcing ribs 46. Each rib has an angled edge 48 at its upper end thereof as shown in FIG. 2. The edges 48 converge upwardly at an acute angle.

For purposes of safety as well as for purposes of minimizing maintenance, the ground engaging element 28 and its pad 12 are preferably interconnected with an enclosure designated generally as 50. The enclosure 50 is made from a rubber-like or elastomeric material which has a thickened bead 52 at its upper end. The inner surface of bead 52 is angled so that it may snap over the ribs 46 and be retained by the angled edges 48. The lower end of the enclosure 50 has a central hole surrounded by an upstanding flange 54. Flange 54 is snapped under a radially disposed flange on the stem 38 adjacent the ground engaging element 28. The enclosure 50 is preferably made from a resilient rubber-like material so that it may be stretched and snapped in place at its upper and lower ends so that it may colapse upon itself when the pad 12 tilts relative to element 28. At the same time the enclosure 50 does not interfere with the ability of the pad 12 to rotate relative to element 28 about the longitudinal axis of the shaft 38. Maintenance is minimized by enclosure 50 which prevents foreign matter from entering into the area of the bearing surfaces. The enclosure 50 also acts like a spring intending to reorientate the pads horizontally if one is tilted relative to ground level. That is, tilting of the pads stretches one side of the enclosure 50. When tilting force is removed, said one side tends to resume its original position such as that shown in FIG. 2.

The enclosure 50 prevents a child from squeezing his finger in the area of the bearing while playing with the device 10. Such squeezing of the finger could occur if the enclosure 50 were not present and the child inserted his finger into the opening 44 while tilting pad 12 relative to element 28. Thus, the enclosure 50 provides advantages in connection with safety as well as maintenance in addition to acting as a spring tending to bias the elements to the orientation shown in FIG. 2.

In order to walk with the device 10, the person must shift his weight to one leg, permit the pad associated with the opposite leg to slightly elevate off ground level, then pivot forwardly, and then return to ground level. The process is repeated with the opposite leg. At any time, the pads may be rotated 360° with respect to one of the ground engaging elements. As shown in FIG. 2, the bottom surface of the ground engaging element 28 is flat and has a diameter greater than the diameter of the cavity 32. The ability to tilt and rotate a pad relative to its ground engaging element adds variety and appeal.

Various modifications of the present invention can be attained. For example, insert 34 may be integral in one piece with the pads, or stem 38 may be separate from and threaded to element 28, or bearing 36 may be solid or hollow, etc.

The present invention may be embodied in other specific forms without departing from the spirit or essential attributes thereof and, accordingly, reference should be made to the appended claims, rather than to the foregoing specification, as indicating the scope of the invention.

I claim:

1. An amusement and/or exercising device comprising first and second pads spaced from each other, each pad being adapted to support one leg of a person, means extending between and rigidly interconnecting said pads, a discrete ground engaging element below and associated with each pad, the improvement comprising means defining a bearing socket approximately $\frac{3}{4}$ of a sphere on the bottom of each pad, a generally spherical bearing in each socket, each bearing being rigidly connected to one of said ground engaging elements, each pad being pivotable relative to its associated element through a limited art to thereby facilitate tilting the pads as a unit so that one pad is higher than the other and off the ground, and each bearing permitting its pad to rotate relative to its associated ground engaging element about a vertical axis.

2. A device in accordance with claim 1 wherein each element has a flat bottom surface and is integrally connected to its associated bearing.

3. A device in accordance with claim 1 wherein each said socket is provided with a conical hole on the lower end thereof, each bearing being connected to its associated ground engaging element therebelow by a shaft extending through one of said holes.

4. A device in accordance with claim 1 including an annular enclosure having one end removably coupled to each pad and its other end removably coupled to the associated ground engaging element, said enclosure being made from an elastomeric material, the coupling of said ends of said enclosure being arranged so as not to interfere with the ability of each pad to rotate through 360° with respect to its associated ground engaging element.

5. A device in accordance with claim 1 wherein the length of said interconnecting means is adjustable.

6. An amusement and/or an exercising device comprising first and second pads, each pad being adapted to support one leg of a person, means rigidly interconnecting said pads, a ground engaging element below and associated with each pad, the improvement comprising means defining a bearing socket on the bottom of each pad, a generally sperical bearing in each socket, each bearing being rigidly connected to one of said ground engaging elements, each pad together with its socket being pivotable relative to their associated element through a limited arc to thereby facilitate tilting the pads as a unit and being rotatable relative to its associated element about a vertical axis, each said socket means being provided with a conical hole on the lower end thereof, each bearing being connected to its associated ground engaging element therebelow by a shaft extending through one of said holes, and a discrete elastomeric annular enclosure around each shaft and having one end removably coupled to the associated pad.

7. An amusement and/or exercising device comprising first and second pads at opposite ends of the device, each pad being adapted to support one leg of a person, means extending between said pads and rigidly interconnecting said pads, a discrete ground engaging element below and associated with each pad, each ground engaging element being coupled to its associated pad by a joint, each joint including a generally spherical bearing in a mating socket so that each pad is pivotable about a horizontal axis through a limited arc relative to its associated ground engaging element to thereby facilitate tilting the pads as a unit so that one pad and its associated element is raised off ground level, each pad being rotatable relative to its associated ground engaging element about a vertical axis, the top surface of said pads being inclined inwardly toward each other, and a discrete elastomeric annular enclosure around each joint, each enclosure extending between each ground engaging element and its associated pad.

* * * * *